US007465071B2

(12) United States Patent
Beukert et al.

(10) Patent No.: US 7,465,071 B2
(45) Date of Patent: Dec. 16, 2008

(54) ELECTRIC LIGHT FIXTURE WITH REFLECTORS

(75) Inventors: Thomas Beukert, Lüdenscheld (DE); Bodo Kleinhaus, Dortmund (DE); Manfred Draxl, Mils (AT)

(73) Assignee: Hoffmeister Leuchten GmbH, Ludenscheid (DE)

( * ) Notice: Subject to any disclaimer, the term of this patent is extended or adjusted under 35 U.S.C. 154(b) by 326 days.

(21) Appl. No.: 11/430,268

(22) Filed: May 8, 2006

(65) Prior Publication Data

US 2006/0291079 A1 Dec. 28, 2006

(30) Foreign Application Priority Data

May 23, 2005 (DE) ..... 20 2005 008 242 U

(51) Int. Cl.
*F21V 7/00* (2006.01)

(52) U.S. Cl. ..... 362/297; 362/298; 362/342; 362/346; 362/347

(58) Field of Classification Search ..... 362/296–298, 362/217, 223, 299–305, 307, 341, 342, 346, 362/347, 327–329, 516–519
See application file for complete search history.

(56) References Cited

U.S. PATENT DOCUMENTS 6,250,772 B1 * 6/2001 Entrop et al. ..... 362/225
2007/0183157 A1 * 8/2007 Holten ..... 362/291

* cited by examiner

*Primary Examiner*—Bao Q Truong
(74) *Attorney, Agent, or Firm*—Andrew Wilford

(57) ABSTRACT

A light fixture has an elongated housing having a floor and side walls defining a transversely open and longitudinally extending outlet and a light source extending longitudinally in the housing. A U-section asymmetrical primary reflector extending longitudinally in the housing between the source and the floor is oriented to reflect light from the source out through the outlet. Two longitudinally extending generally triangular-section secondary reflectors extend longitudinally spacedly adjacent one another between the source and the outlet. The secondary reflectors have outwardly concave first sides directed toward each other, concave second sides directed away from each other, and outwardly concave third sides directed toward the source. Thus light from the source is directed back toward the source and the first reflector by the third sides, is scattered outward through the outlet by the second sides, and is directed outward through the outlet by the first sides.

4 Claims, 1 Drawing Sheet

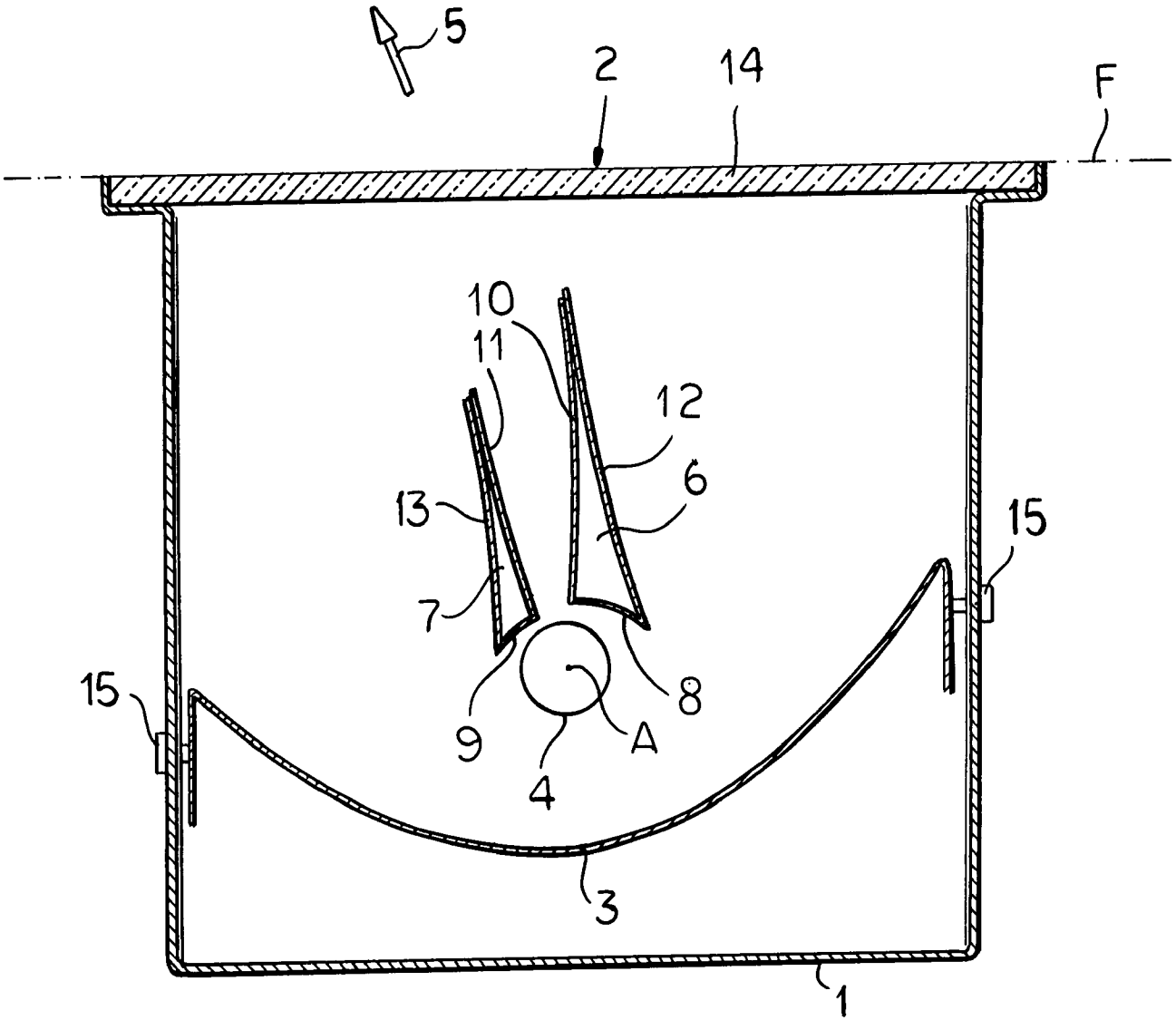
F
5
2
14
15
12
6
10
11
13
7
8
A
9
4
3
1
15

ELECTRIC LIGHT FIXTURE WITH REFLECTORS

FIELD OF THE INVENTION

The present invention relates to an electric light fixture. More particularly this invention concerns such a fixture intended for installation recessed in a wall.

BACKGROUND OF THE INVENTION

An electric lamp or light fixture has a housing having a bottom wall or floor, side walls and a light outlet opening that is covered by a translucent lens or cover, preferably transparent. The housing holds at least one electric light source as well as at least one reflector by means of which the light emitted by the light source are directed out through the outlet opening.

Such lamps are known in the prior art. Such lamps are for example embedded in a floor. The lens is mounted flush and is robust enough to walk on or even drive over with a vehicle.

OBJECTS OF THE INVENTION

It is therefore an object of the present invention to provide an improved recessed electric light fixture.

Another object is the provision of such an improved recessed electric light fixture that overcomes the above-given disadvantages, in particular that is suitable for imbedding in a floor or the ground in or adjacent a building, and wherein undesired light emissions are avoided and a well-adjusted outdoor illumination in particular of building fronts or the like is enabled.

SUMMARY OF THE INVENTION

A light fixture has according to the invention a housing extending along an axis and having a floor and side walls defining a transversely open and axially extending outlet and a light source extending axially in the housing and emitting light radially. A U-section asymmetrical primary reflector extending axially in the housing between the source and the floor is oriented to reflect light from the source out through the outlet. Two longitudinally extending generally triangular-section secondary reflectors extend axially spacedly adjacent one another between the source and the outlet. The secondary reflectors have longitudinally extending, generally parabolic, and outwardly concave first sides directed toward each other, longitudinally extending outwardly concave second sides directed away from each other, and longitudinally extending outwardly concave third sides directed toward the source. Thus light from the source is directed back toward the source and the first reflector by the third sides, is scattered outward through the outlet by the second sides, and is directed outward through the outlet by the first sides.

Thus it is proposed that the primary reflector is disposed in the house near the floor thereof has a surface shaped asymmetrically such that the light is reflected by it in an asymmetrical manner from the light outlet opening. On the other side of the light source two secondary reflectors are disposed, that are set at a spacing from each other and that extend parallel to the longitudinal axis of the light. These secondary reflectors concave sides are directed at to the light source and reflect a part of the light from the source back toward it and the primary reflector. They also have asymmetrical inner sides that face to each other and that form a parabolic partial reflector by means of which the light from the source is focused approximately in the same direction as the light beams that come from the primary reflector. These secondary reflectors also have concave outer side faces by means of which a part of the light from the primary reflector is scattered and sent out to both sides of the principal illumination area, that is the area illuminated by light directly from the source, from the primary reflector, and from the inner sides of the first reflectors.

Such an electric lamp can be mounted for example in the ground or floor in or adjacent a building or other structure. Due to the design, an asymmetrically smooth and soft illumination with focused beams of buildings fronts is possible. Such outer illumination can assume the task of showing and highlighting visually the building architecture and particular elements of the building structure. This illumination of the building fronts and the like is effected projecting light on adjacent buildings or bothering the users of either the building being illuminated or an adjacent building. Due to installation near the front and the asymmetrical illumination characteristic that is oriented toward the building, undesired light emissions are avoided. In outdoor illumination, a scattered or glancing light proportion is furthermore achieved that results in a certain shadiness and makes structures recognizable.

In particular, with such a lamp or light fixture, a good light effect with high-contrast illumination of a building front is achieved, so that the building structures can be highlighted in a targeted way. The installation near the building that is achieved by this design enables one to install such lamps on the private premises of the building, so that neighboring premises or neighboring areas do not have to be used. Also the freedom of movement of abutters or passers-by in the public space is hardly affected. Construction systems such as masts or the like on the premises are not required.

Preferably, it can be further provided that as light source, a T5 fluorescent lamp is used whose longitudinal axis is oriented parallel to the longitudinal axis of the housing.

Due to this, relatively low energy consumption can be achieved with still high efficiency.

Moreover, it is provided that the primary reflectors and/or secondary reflectors are adjustable about a low angle degree, preferably about approximately up to 5°. This design enables an adjustment of the lamp in particular when recessed.

BRIEF DESCRIPTION OF THE DRAWING

The above and other objects, features, and advantages will become more readily apparent from the following description, reference being made to sole figure of the accompanying drawing that is a cross section through the recessed fixture of this invention.

SPECIFIC DESCRIPTION

As seen in the drawing an electric light fixture has a housing 1 that can for example have a square section extending parallel to a horizontal axis A and recessed in a floor or ground surface F. The housing 1 has a light outlet opening 2 that is disposed on the upper side in the drawing that is covered by a translucent cover, for example by a transparent break-proof glass lens 14. In the housing 1, a primary U-section or trough-shaped reflector 3 is disposed near a floor of the housing 1 and has a reflector surface shaped asymmetrically so that light emitted from a light source 4 extending along the axis A is reflected in an asymmetrical manner as shown arrow 5 up through the outlet 2.

On the other side of the light source 4 from the reflector 3, two secondary reflectors 6 and 7 are disposed that are set at a transverse horizontal spacing from each other and that extend parallel to the longitudinal axis A of the source 4 and housing 1. These reflectors 6 and 7 have concave base sides area 8 and 9 that are directed back toward the light source 4 and reflect a part of the light from the light source 4 back to the primary reflector 3. Furthermore, these reflectors 6 and 7 have inner concave side faces 10 and 11 that face to each other and form a parabolic partial reflector by means of which the light from the source 4 is reflected approximately in the same direction as the light from the reflector 3. Furthermore the reflectors 6 and 7 have concave outer lateral surfaces 12 and 13 by means of which a part of the light reflected by the asymmetrical reflector 3 is sent outward or scattered, generating a diffused light that forms a diffused beam on both sides of the principal illumination area in direction 5 of the reflector 3.

The light source 4 is preferably a T5 fluorescent lamp whose longitudinal axis A is oriented parallel to or on the longitudinal axis of the reflector 3 or parallel to a center axis of the housing 1. Preferably reflectors 3 or at least the reflectors 6 and 7 are tippable about a small angle, preferably about approximately 5°, so that after recessing the lamp in the ground, adjustment is possible. Such an electric light fixture enables on the one hand an invisible and inoffensive mounting in the ground in front of a building, wherein by means of the orientation of the outputted light an extremely effective front illumination is achieved that neither bothers the persons within the building nor generates light that bothers people in adjacent structures or nearby.

The invention is not limited to an example of embodiment but is variable in multiple ways in the scope of the disclosure. All new individual or combined features that are disclosed in the description and/or drawing are considered as being substantial of the invention.

We claim:

1. A light fixture comprising:

a housing extending along an axis and having a floor and side walls defining a transversely open and axially extending outlet;

a light source extending axially in the housing and emitting light radially;

a U-section asymmetrical primary reflector extending axially in the housing between the light source and the floor and oriented to reflect light from the light source out through the outlet; and a pair of longitudinally extending generally triangular-section secondary reflectors extending axially spacedly adjacent one another between the light source and the outlet, the secondary reflectors having longitudinally extending, generally parabolic, and outwardly concave first sides directed toward each other, longitudinally extending outwardly concave and generally parabolic second sides directed away from each other, and longitudinally extending outwardly concave third sides directed toward the source, whereby light from the light source is directed back toward the light source and the U-section asymmetrical primary reflector by the third sides, is scattered outward through the outlet by the second sides, and is directed outward through the outlet by the first sides.

2. The light fixture defined in claim 1, further comprising an at least semitransparent lens extending across the outlet.

3. The light fixture defined in claim 1 wherein the light source is an axially extending fluorescent tube.

4. The light fixture defined in claim 1 wherein at least some of the reflectors are tippable through up to about 5° about respective axes.

* * * * *